US007677618B2

(12) United States Patent
Thomann

(10) Patent No.: US 7,677,618 B2
(45) Date of Patent: Mar. 16, 2010

(54) SANITARY TUBULAR PET WASTE REMOVAL DEVICE

(75) Inventor: Michael John Thomann, Charlotte, NC (US)

(73) Assignee: Michael Thomann, Charlotte, NC (US)

( * ) Notice: Subject to any disclaimer, the term of this patent is extended or adjusted under 35 U.S.C. 154(b) by 325 days.

(21) Appl. No.: 11/386,314

(22) Filed: Mar. 22, 2006

(65) Prior Publication Data

US 2006/0214440 A1 Sep. 28, 2006

Related U.S. Application Data

(60) Provisional application No. 60/664,432, filed on Mar. 23, 2005.

(51) Int. Cl.
*A01K 29/00* (2006.01)
*E01H 1/12* (2006.01)

(52) U.S. Cl. ..... 294/1.3; 294/55

(58) Field of Classification Search ..... 294/1.1, 294/1.3, 1.4, 1.5, 55; 15/257.1, 257.6
See application file for complete search history.

(56) References Cited

U.S. PATENT DOCUMENTS 1,990,026 A * 2/1935 Glen, Jr. ..... 15/257.6
3,827,098 A * 8/1974 Sanderson ..... 294/1.4
3,910,619 A * 10/1975 Schmieler ..... 294/1.4
4,017,015 A * 4/1977 Jefferson ..... 294/1.3
4,865,371 A * 9/1989 Egberg ..... 294/1.3
D310,436 S * 9/1990 Krauth ..... D30/161
5,318,330 A * 6/1994 Dombrowski ..... 294/1.3
5,382,063 A * 1/1995 Wesener et al. ..... 294/1.3
D377,247 S * 1/1997 Albert ..... D30/162
5,628,537 A * 5/1997 Kiemer ..... 294/1.4
6,039,368 A * 3/2000 Kowalczyk ..... 294/1.3
6,941,896 B1 * 9/2005 Morin ..... 119/867
2005/0275228 A1 * 12/2005 Davis ..... 294/1.3

FOREIGN PATENT DOCUMENTS

CH 672873 * 1/1990

* cited by examiner

*Primary Examiner*—Dean J Kramer
(74) *Attorney, Agent, or Firm*—Jim Wright

(57) ABSTRACT

A sanitary tubular pet waste removal device includes a hollow proximal section having a handle extending from a first end thereof and a hollow distal section extending from a second end of the proximal section, the second end opposite the first end. One or both of the distal and proximal sections includes a scoop arranged to nest within the sections when not in use, and the interior of the distal section is adapted to temporarily hold and sanitarily retain fecal matter. Together, the proximal and distal sections form a bat-like structure when not in use, thereby facilitating ease of carrying by a user. The handle of the proximal section includes a separable light source arranged to illuminate the exterior of the unit, acting as a safety light, and also arranged to shine down to the ground beneath, thereby facilitating the process of locating target fecal matter.

19 Claims, 5 Drawing Sheets

S3

S3

S3

S3

S3

SANITARY TUBULAR PET WASTE REMOVAL DEVICE

CROSS-REFERENCE TO RELATED APPLICATION

This application is entitled to the benefit of, and claims priority to provisional U.S. Patent Application Ser. No. 60/664,432 filed Mar. 23, 2005 and entitled "S3," the entirety of which is incorporated herein by reference.

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE PRESENT INVENTION

1. Field of the Present Invention

The present invention relates generally to pet waste removal devices.

2. Background

Laws require that all pet waste must be removed in public spaces due to the potentially life-threatening diseases that can be contracted from pet waste, along with the unpleasant odor and appearance. An infected dog can shed as many as 50 million worm eggs in only 1 week! Cleaning up animal waste is cumbersome, unsanitary, smelly, and embarrassing. Animal lovers have become accustomed to carrying plastic bags or heavy/cumbersome devices to clean up after their pets during a walk. Traditional "jaw-like" pooper scoopers are unable to handle the task when there is multiple pet waste to be cleaned. These methods are inconvenient, ineffective, malodorous, and can be unsanitary and unhealthy. Waste receptacles are not always immediately available which forces the pet owner to carry bags of pet waste until they arrive home or find a proper receptacle. Dogs need to be walked regardless of the time of day, and many pet owners find themselves walking their pets in poor lighting or in the dark. Walking in the dark can be dangerous for both the pet owner and pet as they are apt to getting attacked from other people or animals.

SUMMARY OF THE PRESENT INVENTION

The present invention comprises a sanitary tubular pet waste removal device. The revolutionary design of the device (to be marketed under as the S³™, which is suggestive of the term "sanitary safety stick") finally solves all these problems of walking your dog. The pet waste removal device of the present invention includes a built-in flashlight, integrated and concealed scoops, inverted handle, and convenient temporary storage compartment. The bat-like design of the device also offers a defense against other people or animals that may intend to cause harm. The integrated light source not only provides a lighted walking stick for safety and visibility purposes, but also helps provide light to the "target area" when picking up fecal material. The large storage area of the device allows for multiple fecal pick ups for the multiple pet owner, or while cleaning a large area such as the backyard. The device is preferably made of lightweight plastic composite that allows for easy and thorough cleaning, and can be kept hung outside to dry and store with it's convenient carry strap.

The pet waste removal device of the present invention is a convenient, lightweight, ergonomic, sanitary, and multi-functional solution for the unpopular chore of cleaning up pet waste while on a walk, or in your own yard. The device has an integrated light system, carry strap, built-in scoops, and inverted base handle with a secure temporary storage area for animal waste. In addition, the bat-like design and its illumination capabilities offer extra security and safety to pet owners and their animals while on a walk. The device's hollow body is preferably made of lightweight durable plastic composite that allows for easy cleaning, and convenient temporary storage of waste while on a walk. The built-in scoops of the device make for quick and convenient clean-up of pet waste from all surfaces including deep grass, sand, and cement. Further, the device can optionally be fitted with disposable bags for added convenience and cleanliness.

Broadly defined, the present invention according to one aspect is a sanitary tubular pet waste removal device including: a proximal section having a handle extending from a first end thereof, at least a portion of which is hollow; and a hollow distal section extending from a second end of the proximal section, the second end opposite the first end, wherein the distal section includes a scoop arranged to nest within the proximal section when not in use, and wherein the interior of the distal section is adapted to temporarily hold and sanitarily retain fecal matter; wherein the proximal and distal sections together form a bat-like structure when not in use, thereby facilitating ease of carrying by a user.

In features of this aspect, the handle of the proximal section includes a light source arranged to shine downward through the proximal section to illuminate the ground beneath, thereby facilitating the process of locating target fecal matter; the light source/handle may be separated from the proximal section; the walls of the proximal and distal sections are at least partially translucent, thereby facilitating the external illumination of the walls when the light source is in use; the proximal section includes a scoop adapted to be manipulated in conjunction with the scoop of the distal section to handle fecal matter; the device further includes a disposable bag arranged within the interior of the distal section for receiving collected fecal matter; and the distal section includes an inverted handle on the bottom thereof for facilitating manipulation by a user.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
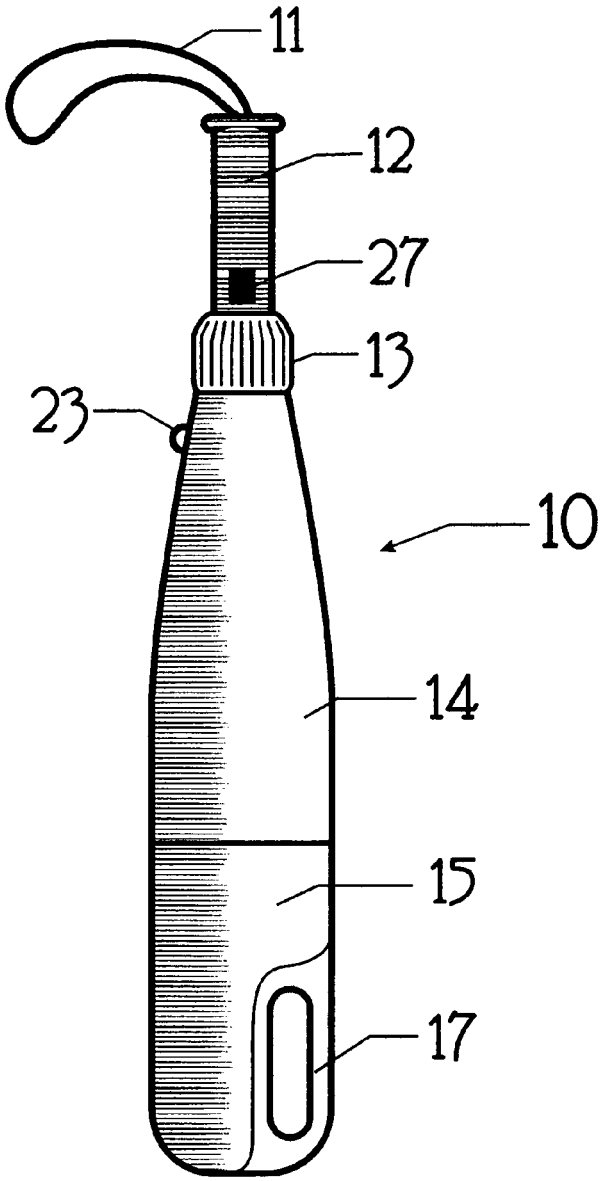
FIG. 1 is a side perspective view of a sanitary tubular pet waste removal device in accordance with the preferred embodiments of the present invention.
Figure 2:
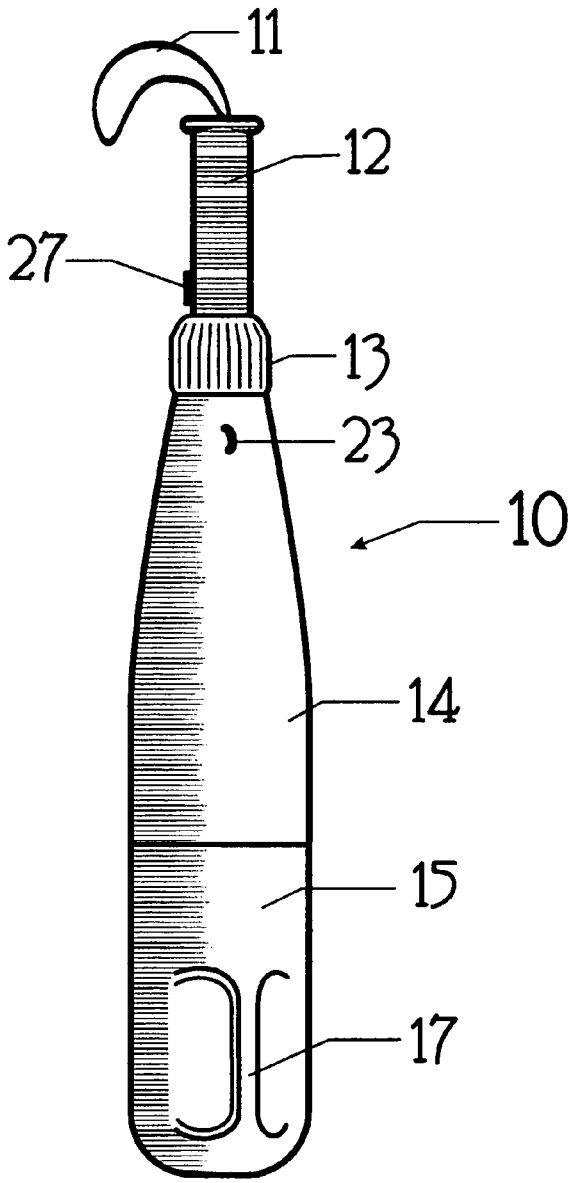
FIG. 2 is a front perspective view of the pet waste removal device of FIG. 1.
Figure 5:
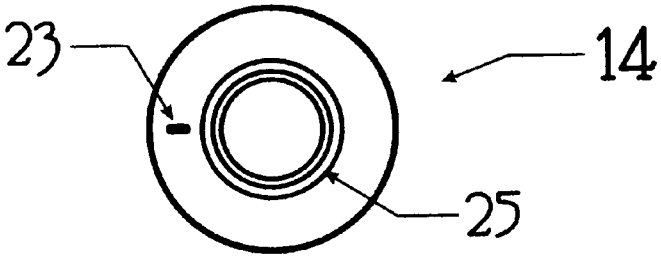
FIG. 5 is a top view of the proximal section of FIG. 3.

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

FIG. 1 is a side perspective view of a sanitary tubular pet waste removal device 10 in accordance with the preferred embodiments of the present invention. The pet waste removal device 10 is a hollow, tubular, bat-like structure with secure interlocking sections 14, 15, an inverted carry handle 17 built into one of the sections 15, an integrated waterproof light source 12, with an on/off switch 27, and a carry strap 11. The device 10 is preferably made of highly durable, lightweight, and washable semi-translucent or solid plastic material that may be made of various colors.

Figure 3:
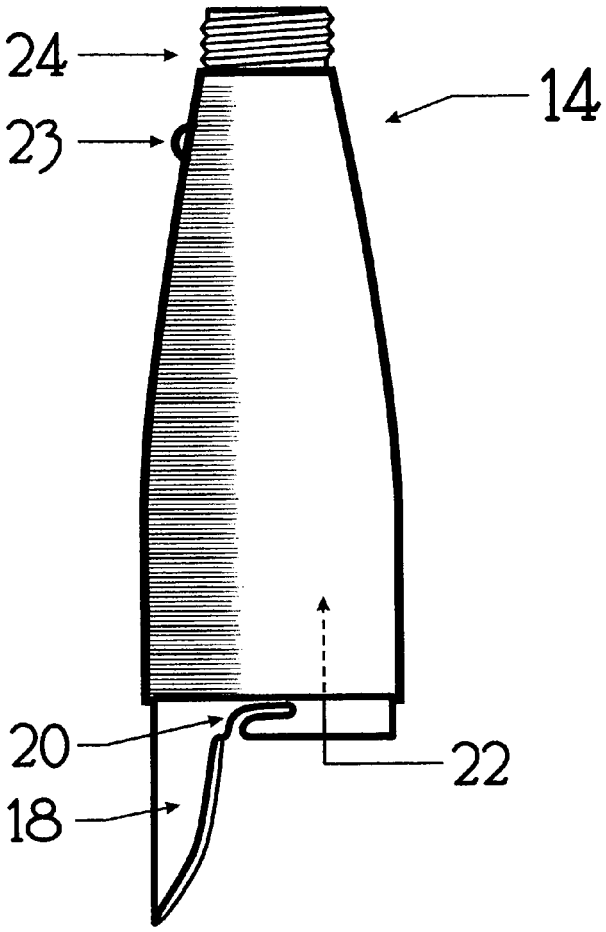
FIG. 3 is a side view of a proximal section of the pet waste removal device of FIG. 1.
Figure 4:
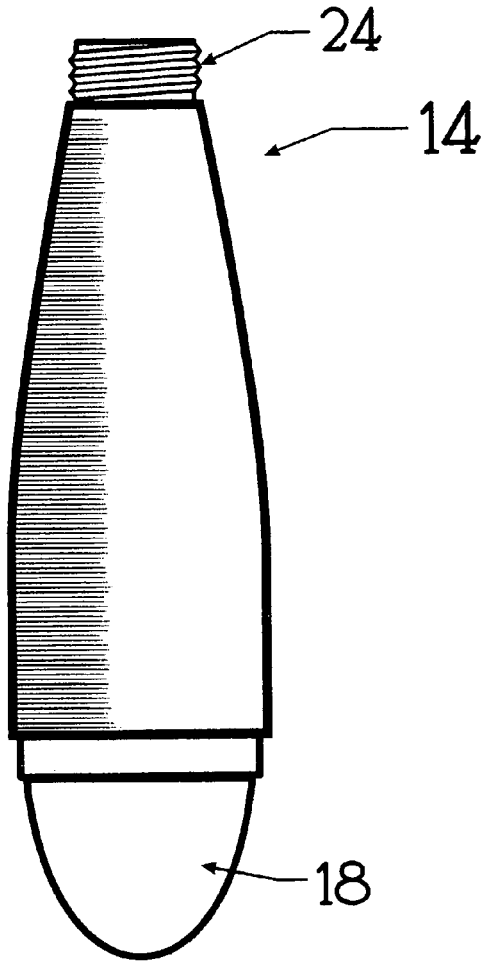
FIG. 4 is a front view of the proximal section of FIG. 3.
Figure 8:
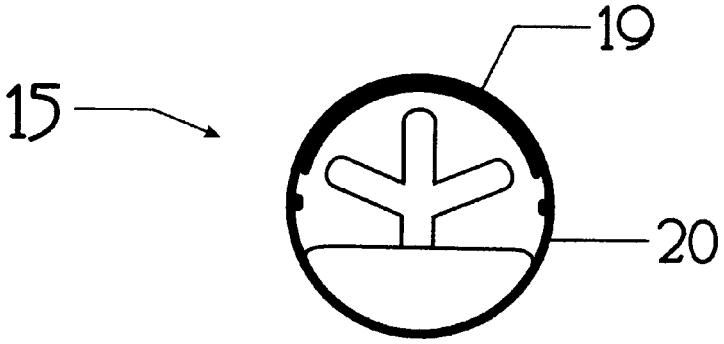
FIG. 8 is a top view of the distal section.
Figure 6:
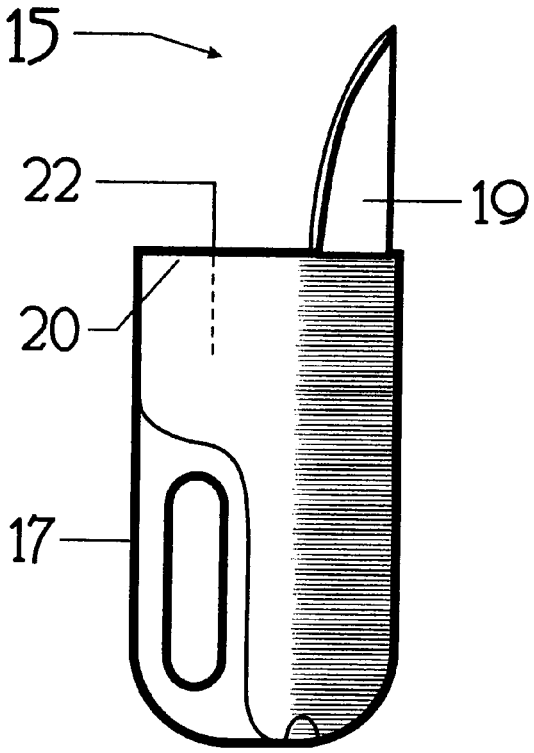
FIG. 6 is a side view of a distal section of the pet waste removal device of FIG. 1.
Figure 7:
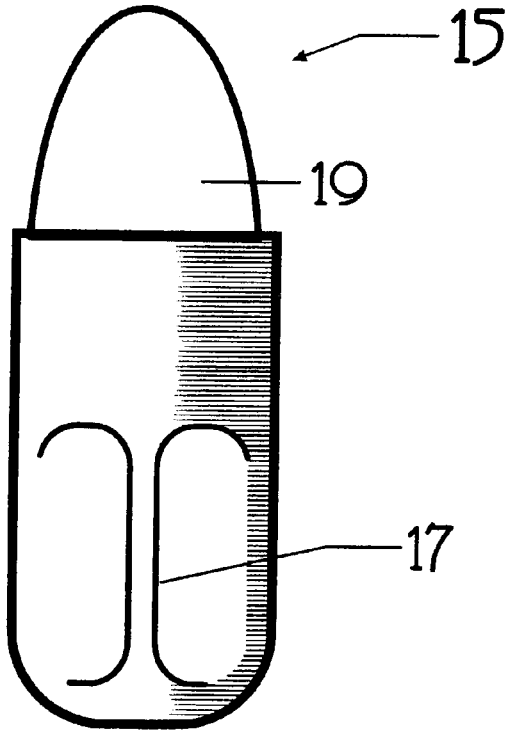
FIG. 7 is a front view of the distal section.
Figure 12:
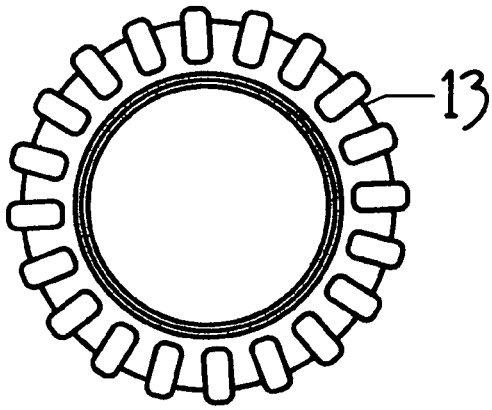
FIG. 12 is an enlarged top view of the locking collar of FIG. 9.
Figure 10:
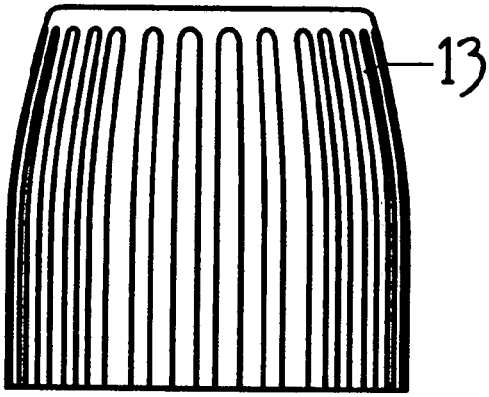
FIG. 10 is an enlarged side view of the locking collar of FIG. 9.
Figure 11:
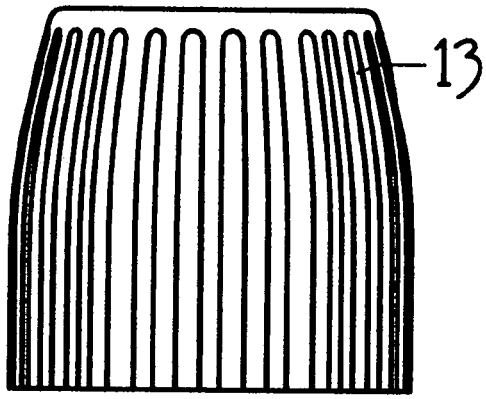
FIG. 11 is an enlarged front view of the locking collar of FIG. 9.
Figure 9:
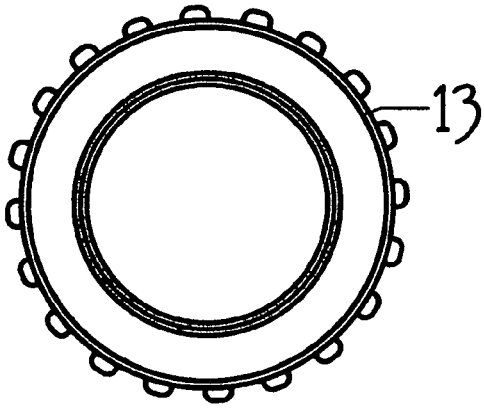
FIG. 9 is an enlarged bottom view of a locking collar of the pet waste removal device of FIG. 1.
Figure 13:
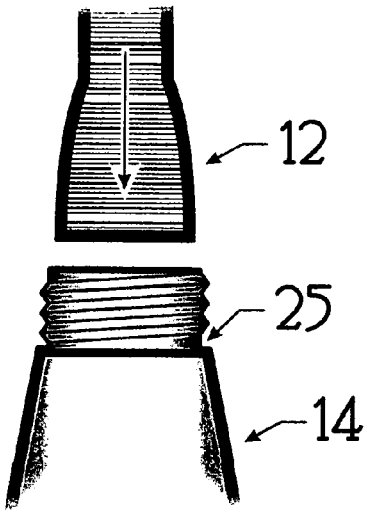
FIG. 13 is an enlarged side view of a locking mechanism of the pet waste removal device of FIG. 1, shown in a disconnected state.
Figure 14:
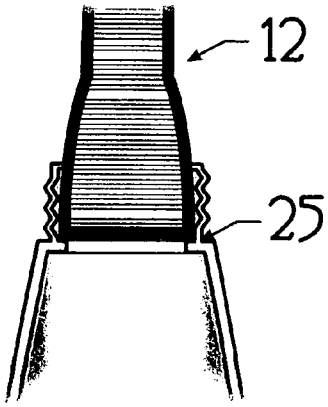
FIG. 14 an enlarged side view of the locking mechanism of FIG. 13, shown in a connected state.
Figure 15:
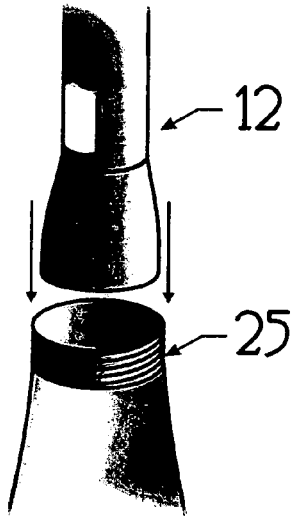
FIG. 15 is a side view and a top perspective view of the locking mechanism of FIG. 13, illustrating the process of connecting a light/handle to the proximal section of the pet waste removal device.
Figure 16:
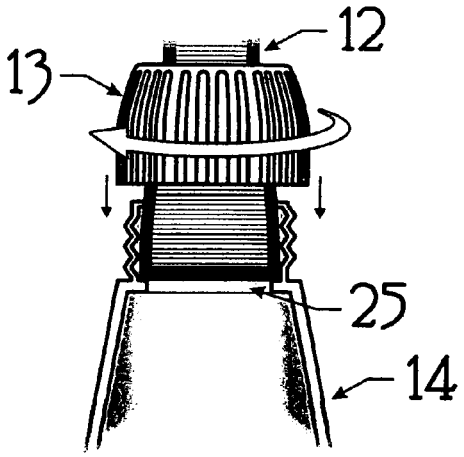
FIG. 16 is another side view and a top perspective view of the locking mechanism of FIG. 13, illustrating the process of connecting a light/handle to the proximal section of the pet waste removal device.
Figure 17:
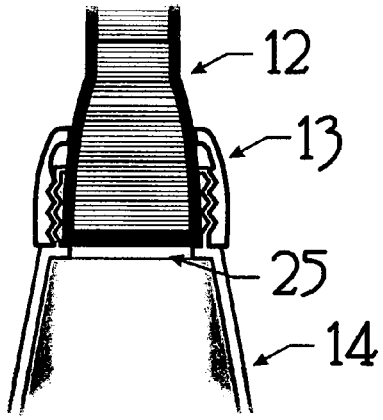
FIG. 17 is a side cross-sectional view and a side perspective cross-sectional view of the locking mechanism of FIG. 13, shown in a connected state.

The primary components of the device 10 include a carry strap 11, a light source 12, a locking mechanism 13, 24, a proximal hollow section 14 ending in a spade-shaped scoop 18 (best seen in FIGS. 3 and 4) and a distal hollow section 15 (sometimes referred to as a "base unit") with an opposing spade-shaped scoop 19 (best seen in FIGS. 6 and 7). The distal hollow section 15 also has a dimpled bottom for upright capabilities, and has a built-in carry handle 17. The hollow sections 14, 15 are held together by a locking mechanism or similar type as appropriate, and together define an interior chamber 22. The lower portion of this chamber 22, generally defined by the distal section or base unit 15, may be fitted with bags (not shown) that may optionally be held in by the scoops 18, 19 and/or retainer clips or other type of holding device deemed appropriate. In a preferred embodiment, the bags are custom biodegradable bags that are sized and fitted specifically fir the base unit 15, but it will be apparent that the bags may be of any suitable material, including various paper and plastic materials, and that the lower chamber of the base unit 15 may alternatively be fitted with a standard grocery bag or other readily available bag.

The device 10 may be carried using the carry strap 11 or the light source 12 while on a walk or in the user's backyard. The device 10 may be used with the light source 12 turned on or off with switch 27. The device 10 may also be made without a light source 12, replacing the light source 12 with a rubber or plastic composite handle (not shown). When the user encounters fecal material, the upper hollow section 14 is turned in a counter-clockwise or twisting direction with one hand while the opposite hand holds the inverted handle 17 to unlock the two main body sections 14, 15. Once unlocked, the concealed scoops 18, 19 are exposed and may be used to oppose the fecal material so that it may be easily scooped into the distal section 15. At night time the light source 12 illuminates the device 10 from the inside, thus permitting the device 10 to act as a lighted walking stick. In addition, when scooping waste, the light source 12 helps shine light on the "target" area. Once all the fecal material is scooped into the distal section 15, it may then be carried to a proper waste receptacle. Alternatively, with a twisting turn clockwise, the lower section 15 may be re-attached securely with the locking mechanism 20 to the proximal section 14, and the pet and the pet owner may continue on their walk until a proper receptacle is located.

The locking mechanism includes a collar 13 and a corresponding fitting 24 for connection with the collar 13. The collar 13 preferably has a female screw fitting (not shown) or similar type which fits over the light source/handle 12 to lock it down onto the corresponding threads 24 of the proximal body section 14. The carry handle/light source 12 is arranged just inside the proximal section 14 on a rim shelf 25. The collar locking mechanism 13 may also be fashioned to lock the light source 12 or other carry handle in place with another appropriate method deemed secure such as a ¼ turn lock mechanism, a snap type fitting, or the like. The design of the handle/light source 12 also allows for solo (detached) use of the light source 12 as well as easy maintenance of the light source 12 and hollow sections 14, 15 of the device 10. The device 10 may also be designed and made with the handle 12 formed or otherwise manufactured integrally with the proximal section 14.

The body of the device 10 is designed such that the opposing scoops 18, 19 are concealed inside the respective hollow sections 15, 14 until it is deemed necessary to reveal them for use. The design of the opposing scoops 18, 19 allows for easy, quick, and multiple fecal clean ups from all surfaces including deep grass, sand, gravel, and cement. The ergonomic and fashionable shape of the device 10 makes for easy carrying. The device's integrated scoops 18, 19 and temporary storage compartment 22 allow for less embarrassing moments while picking up after your pet while on a walk or at home. As described previously, the two main sections 14, 15 of the device 10 are held together by a conventional groove type locking mechanism 20 which allows for secure temporary storage of fecal material with just a twist. The locking mechanism 20 of the two main sections 14, 15 may also be composed of a screw type mechanism, or another type deemed appropriate. The inverted handle 17 offers extra control while in use. The dimpled end of the distal section 15 allows for upright capabilities and for easy insertion/removal of optional disposable bags.

Notably, the various dimensions of the device 10 or its individual components, such dimensions including the overall length, diameter, or the like, made be made bigger or smaller to accommodate different sized dogs and their owners' needs. Further, in a commercial sales method, different sizes of the device 10 may be offered for sale and specifically labeled and otherwise targeted toward different sized dogs.

Still further, the device 10 may be marketed to and used by owners of other animals, such as house cats, domesticated (pet) pigs, and the like.

The body of device 10 is designed with a integrated semi-circular ring 23 or similar shaped ring deemed appropriate to allow for hanging capabilities. This ring can be used to attach a hook or similar hanging device to allow for hanging up ready access, or belt clip attachment for use while walking.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A sanitary tubular pet waste removal device comprising:

a proximal section having a handle extending from a first end thereof, the handle including a light source arranged to shine downward through the proximal section to illuminate the ground beneath, thereby facilitating the process of locating target fecal matter; and a distal section extending from a second end of the proximal section, the second end opposite the first end;

wherein at least a portion of each of the proximal section and the distal section is hollow and wherein at least one of the proximal section and the distal section has an interior that is adapted to temporarily hold and sanitarily retain fecal matter;

wherein at least one of the distal section and the proximal section includes a scoop arranged to nest within the opposing section when not in use;

wherein the proximal and distal sections may be connected together to form an enclosed structure, thereby facilitating ease of carrying by a user.

2. The device of claim 1, wherein the enclosed structure is a bat-like or bottle-like structure, thereby facilitating ease of carrying by a user.

3. The device of claim 1, wherein the proximal and distal sections may be disconnected from one another and manipulated to remove fecal matter from a ground surface to the interior of the hollow section.

4. The device of claim 1, wherein the light source may be separated from the proximal section.

5. The device of claim 1, wherein the walls of the proximal and distal sections are at least partially translucent, thereby facilitating the external illumination of the walls when the light source is in use.

6. The device of claim 1, wherein the walls of the proximal and distal sections are at least partially transparent.

7. The device of claim 1, wherein the scoop is included in the distal section, and wherein the proximal section also includes a scoop adapted to be manipulated in conjunction with the scoop of the distal section to handle fecal matter.

8. A sanitary tubular pet waste removal device comprising:

a hollow proximal section with opposing first and second ends; and a hollow distal section that extends from the second end of the proximal section and is completely separable and removable from the proximal section, the distal section including:

an interior that is adapted to temporarily hold and sanitarily retain fecal matter, and a generally spade-shaped scoop extending outwardly away from an inner side wall of the interior of the distal section;

wherein the proximal and distal section are generally contiguous with one another when the distal section is connected to the proximal section such that the scoop is offset inwardly from and nestled generally flush against an inner side wall of the proximal section when the proximal and distal sections are connected to one another; and wherein the scoop is arranged to nest fully within the proximal section when the distal section is connected to the proximal section; and wherein the proximal and distal sections may be disconnected from one another and manipulated to remove fecal matter from a ground surface to the interior of the distal section.

9. The device of claim 8, wherein the hollow proximal section includes a ring structure adapted to support the connected proximal and distal sections in a vertical hanging orientation.

10. The device of claim 8, wherein a substantial portion of each of the proximal section and the distal section is cylindrical in shape.

11. The device of claim 8, wherein the second end of the proximal section has a circular opening, and an end of the distal section, facing the proximal section when the distal section is connected to the proximal section, has a circular opening.

12. The device of claim 8, wherein a groove type twisting locking mechanism is utilized to hold the hollow proximal and distal sections together.

13. The device of claim 8, wherein the proximal section includes a generally spade-shaped scoop extending outwardly away from an interior thereof.

14. A sanitary tubular pet waste removal device comprising:

a proximal section, having one or more side walls and an end wall that collectively define a first receptacle portion that is adapted to hold and sanitarily retain fecal matter, and having opposing first and second ends with a hollow, tubular portion extending therebetween, wherein the first end is closed by the end wall and includes a handle, wherein the second end is open, and wherein the hollow tubular portion is closed on all other sides by the one or more side walls; and a hollow, tubular distal section, having one or more side walls and an end wall that collectively define a second receptacle portion that is adapted to hold and sanitarily retain fecal matter, and having first and second ends with a hollow, tubular portion extending therebetween, wherein the first end is closed by the end wall, wherein the second end is open, wherein the hollow tubular portion is closed on all other sides by the one or more side walls, and wherein the distal section is completely separable and removable from the proximal section;

wherein the second end of the distal section attaches at the second end of the proximal section when the distal and proximal sections are attached together;

wherein the distal and proximal sections are contiguous with one another when attached together;

wherein a side wall of at least one of the distal section and the proximal section includes a scoop extending therefrom and arranged to be offset from and nestled flush against an inner side wall of the opposing section when the distal section is connected to the proximal section; and wherein the proximal and distal sections may be disconnected from one another and manipulated to remove fecal matter from a ground surface to the interior of the distal section.

15. The device of claim 14, wherein the hollow proximal section includes a ring structure adapted to support the connected proximal and distal sections in a vertical hanging orientation.

16. The device of claim 14, wherein a substantial portion of each of the proximal section and the distal section is cylindrical in shape.

17. The device of claim 14, wherein the second end of the proximal section has a circular opening, and the second end of the distal section, facing the proximal section when the distal section is connected to the proximal section, has a circular opening.

18. The device of claim 14, wherein the scoop is spade-shaped.

19. The device of claim 14, wherein a groove type twisting locking mechanism is utilized to hold the hollow proximal and distal sections together.

* * * * *